US007039206B2

(12) United States Patent
Mellow

(10) Patent No.: US 7,039,206 B2
(45) Date of Patent: May 2, 2006

(54) DUAL DIAPHRAGM SPEAKER

(75) Inventor: Timothy Mellow, Farnham (GB)

(73) Assignee: Nokia Corporation, Espoo (FI)

( * ) Notice: Subject to any disclaimer, the term of this patent is extended or adjusted under 35 U.S.C. 154(b) by 576 days.

(21) Appl. No.: 09/892,640

(22) Filed: Jun. 28, 2001

(65) Prior Publication Data

US 2003/0002697 A1 Jan. 2, 2003

(51) Int. Cl.
*H04R 25/00* (2006.01)

(52) U.S. Cl. ..... 381/190; 381/89; 381/333; 381/388

(58) Field of Classification Search ..... 381/173, 381/190, 114, 182, 186, 89, 332, 388, 333, 381/306, 87, 386, 387; 455/350; 310/322, 310/324, 332, 334, 800; 379/433.04, 432, 379/440; 361/680, 681, 683, 687; 181/141
See application file for complete search history.

(56) References Cited

U.S. PATENT DOCUMENTS 3,947,644 A 3/1976 Uchikawa et al.
4,352,961 A * 10/1982 Kumada et al. ..... 455/350
5,185,549 A * 2/1993 Sullivan ..... 310/334
6,023,123 A * 2/2000 Petiet ..... 310/322
6,363,157 B1 * 3/2002 Chick ..... 381/89
6,427,017 B1 * 7/2002 Toki ..... 381/190

FOREIGN PATENT DOCUMENTS

| | | |
|---|---|---|
| FR | 2 651 633 | 3/1991 |
| FR | 2 651 633 A | 3/1991 |
| GB | 2 330 980 A | 5/1999 |
| GB | 2 343 811 A | 5/2000 |
| JP | 01 144896 | 6/1989 |
| JP | 01 144896 A | 6/1989 |
| JP | 09 238393 A | 9/1997 |
| JP | 09 238393 | 1/1998 |

* cited by examiner

*Primary Examiner*—Huyen Le
(74) *Attorney, Agent, or Firm*—Alston & Bird LLP

(57) ABSTRACT

A dual diaphragm speaker comprising first and second diaphragms operating in accordance with the piezoelectric effect, the diaphragms being arranged to be driven in opposite phase with respect to one another so as to cancel out non-linearities. The speaker is made transparent and mounted over the display panel of a mobile telephone.

13 Claims, 4 Drawing Sheets

DUAL DIAPHRAGM SPEAKER

BACKGROUND OF THE INVENTION

1. Field of the Invention

This invention relates to the field of speakers, particularly but not exclusively to a dual diaphragm piezo-electric speaker for an integrated hands-free portable communications device.

2. Description of the Prior Art

Integrated hands free (II-IF) handsets are a relatively recent development in mobile telephone technology. As such handsets become lighter and more compact, there is an ever-increasing requirement for the size and weight of speakers to be reduced and for quality to be increased. This is especially so as speakers are used for polyphonic ringer melodies, downloaded midi music files, text-to-speech conversion, FM radio and so on. Efficiency is also an issue when trying to maximize talk time with IHF speech.

Many different types of speaker are known, including a single diaphragm gas filled piezo-electric dome speaker, for example the Audax FTD-3P. Such speakers are prone to non-linearities and even harmonic distortion, for example due to the outward excursion of the speaker diaphragm being less than the inwards excursion for a given voltage. A single diaphragm speaker also suffers from the drawback that the gas acts as a non-linear spring, providing a stiffness which varies with volume.

SUMMARY OF THE INVENTION

The present invention addresses the above problems of the prior art.

According to the present invention, there is provided a speaker comprising first and second diaphragms arranged to be driven in opposite phase with respect to one another.

Advantageously, the dual diaphragm arrangement provides for the cancellation of even harmonic distortion since the harmonic distortion produced by the expansion of one diaphragm is cancelled by the corresponding contraction of the other and vice-versa.

The speaker can be transparent and can be arranged to be located over the display, so that the display is visible through the speaker.

The invention also provides an electronic device including a display and a transparent speaker, the speaker being mounted in front of the display so that the display is visible through the speaker. The speaker can be any transparent speaker, including single diaphragm and dual diaphragm piezoelectric speakers.

As mobile devices perform more visual functions such as photography, GPS location, web browsing, personal digital assistance and so on, the display is likely to take up more of the available space, with consequential requirements on the speaker to be as small as possible. However, small speaker diaphragms have to move a greater distance than large ones to produce a given sound pressure level, which leads to greater distortion. Small speakers are also less efficient, which reduces talk time. By providing a transparent speaker which can be as large as the display area, a better quality speaker can be produced while minimizing the demands on space within the device.

According to the invention, there is further provided a speaker comprising first and second opposed diaphragms, the diaphragms being arranged to be driven so that, in use, they move in the same direction with respect to one another.

The space between the diaphragms can be filled with a gas having a large molecular size, to prevent leakage. Since the volume of gas between the diaphragms remains substantially constant as they move in the same direction, this removes a potential source of non-linearity with respect to a speaker in which a single diaphragm moves relative to a fixed backplate.

BRIEF DESCRIPTION OF THE DRAWINGS

Embodiments of the invention will now be described, by way of example, with reference to the accompanying drawings, in which.

DETAILED DESCRIPTION OF THE INVENTION

Figure 1:
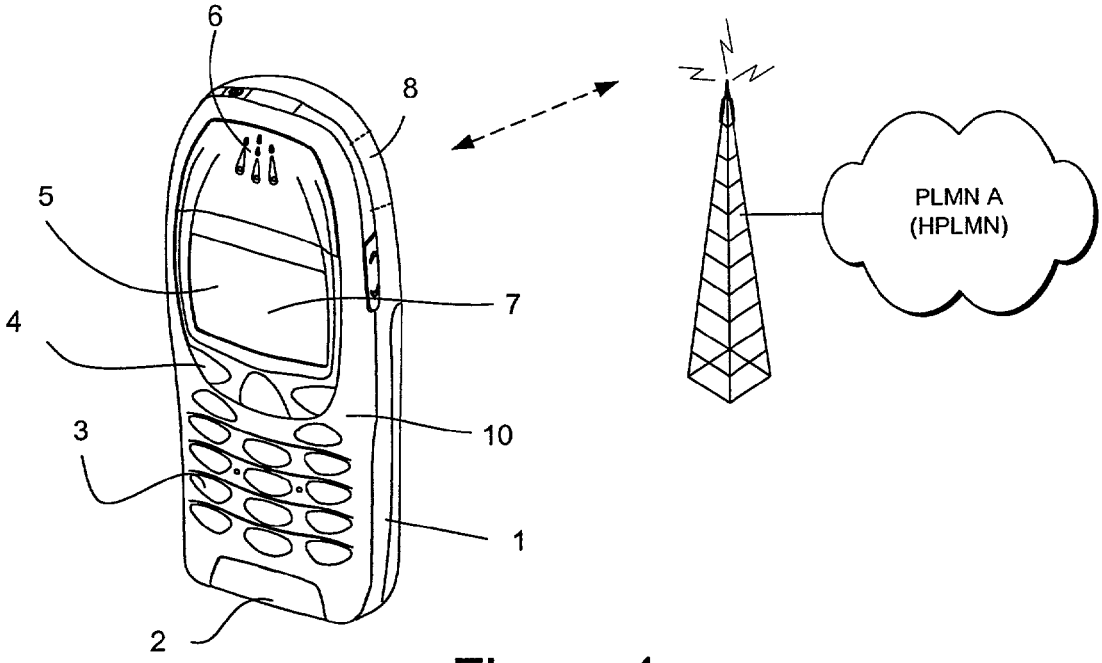
FIG. 1 is a perspective view of a mobile telephone handset.
Figure 2:
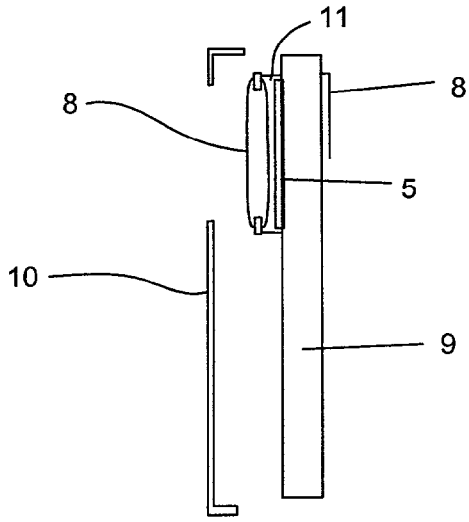
FIG. 2 is a simplified schematic cross-sectional view of the handset shown in FIG. 1 illustrating the position of a dual diaphragm speaker according to the invention.

Referring to FIGS. 1 and 2, a mobile station in the form of a mobile telephone handset 1 includes a microphone 2, keypad 3, with a hands-free mode selection key 4, an LCD display 5, an earphone speaker 6, a hands-free speaker 7 and an internal antenna 8 (not shown). The hands-free speaker 7 is a transparent speaker located between the display 5, which is mounted to the handset's PCB 9, and the front cover of the handset 10. The space 11 between the speaker 7 and the display 5 acts as an acoustic cavity and can include a reflex port (not shown), for example to improve performance for mid-range use.

The mobile station 1 is operable to communicate through cellular radio links with individual PLMNs (public land mobile network) shown schematically as PLMN A, for example a GSM 1800 MHz network.

Figure 3:
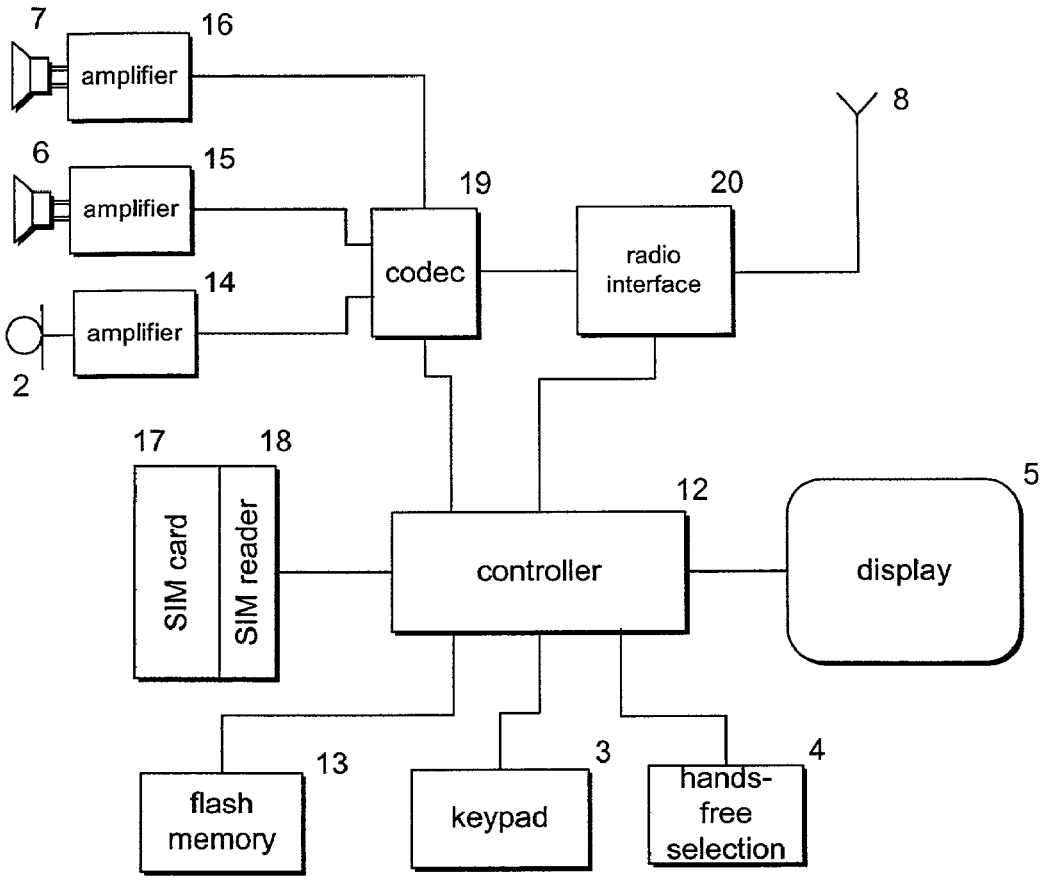
FIG. 3 is a schematic diagram of mobile telephone circuitry for use in the telephone handset of FIG. 1.

FIG. 3 illustrates the major circuit components of the telephone handset 1. Signal processing is carried out under the control of a digital micro-controller 12 which has an associated flash memory 13. Electrical analog audio signals are produced by microphone 2 and amplified by pre-amplifier 14. Similarly, analog audio signals are fed to the speakers 6, 7 through respective amplifiers 15, 16. The amplifier 16 for the hands-free speaker 7 is, for example, a digital class D amplifier. The micro-controller 12 receives instruction signals from the keypad 3 and hands-free mode selection key 4 and controls operation of the LCD display 5. The hands-free mode selection key 4 is used to instruct the micro-controller 12 to switch between the earphone speaker 6 and the hands-free speaker 7.

Information concerning the identity of the user is held on a smart card 17 in the form of a GSM SIM card which contains the usual GSM international mobile subscriber identity (IMSI) and an encryption key $K_1$ that is used for encoding the radio transmission in a manner well known per se. The SIM card is removably received in a SIM card reader 18.

The mobile telephone circuitry includes a codec 19 and an rf stage 20 feeding the antenna 8.

Figure 4:
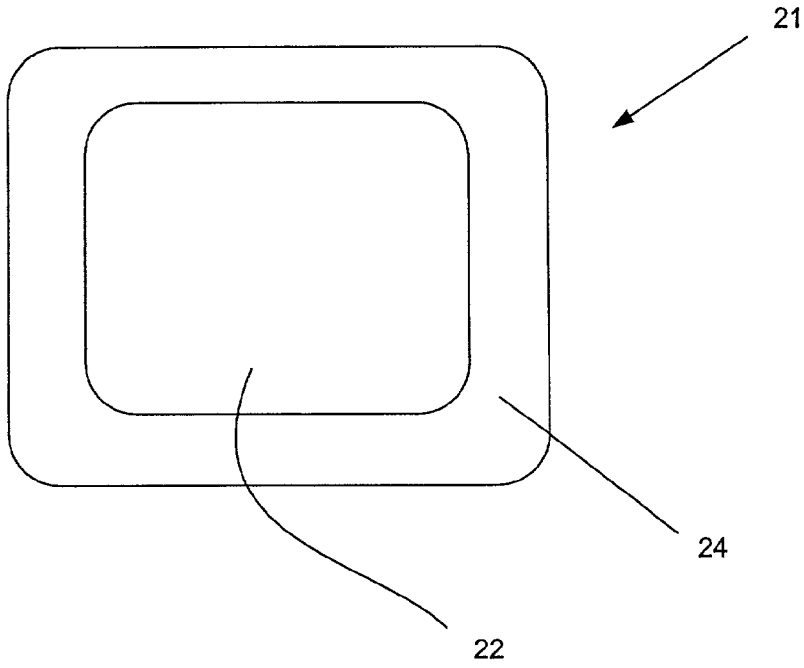
FIG. 4 is a schematic front view of a dual diaphragm speaker according to the invention.
Figure 5:
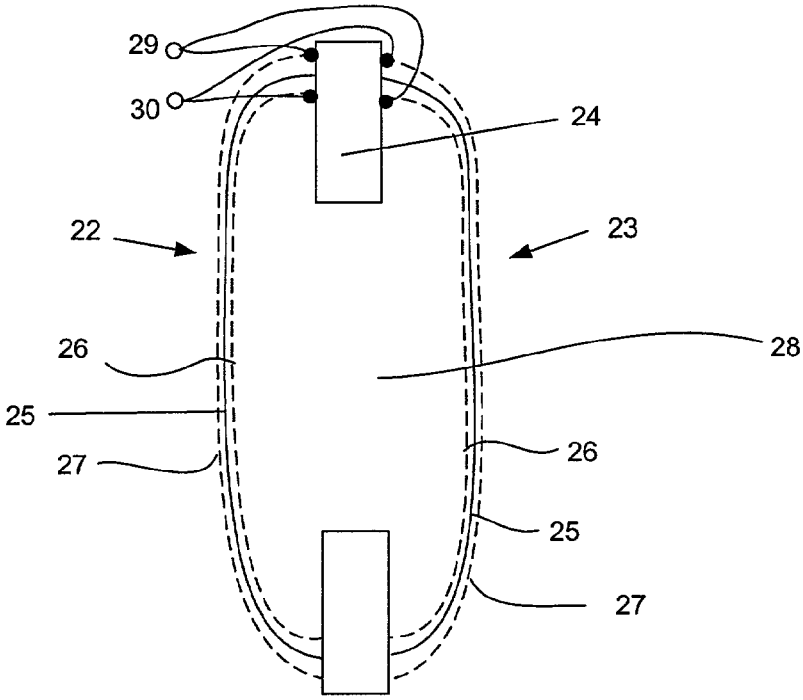
FIG. 5 is a schematic cross-sectional view of the dual diaphragm speaker of FIG. 4.

Referring to FIGS. 4 and 5, a dual diaphragm speaker 21 according to the invention comprises first and second diaphragms 22, 23 mounted to an insulating support frame 24. Each diaphragm 22, 23 comprises a transparent piezoelectric polymer film 25, for example a 6~i.m thick film of polyvinylidene fluoride (PVDF), which is coated on its inner and outer surfaces 26, 27 with a transparent conductive material, for example indium tin oxide (ITO), to form inner and outer electrodes. The cavity 28 between the diaphragms 22, 23 is filled with a gas with a large molecular size, to prevent it escaping through the diaphragms, for example, sulphur tetrafluoride $SF_4$. The gas pressure is arranged to keep the diaphragms in tension, so that they form a dual dome shape.

The inner and outer electrodes 26, 27 of each diaphragm are connected to the output of the amplifier 16 so that a first input terminal 29 is connected to the outer coating 27 of the first diaphragm 22 and an inner coating 26 of the second diaphragm 23, while a second input terminal 30 is connected to the inner coating 26 of the first diaphragm 22 and an outer coating 27 of the second diaphragm 23.

Figure 6:
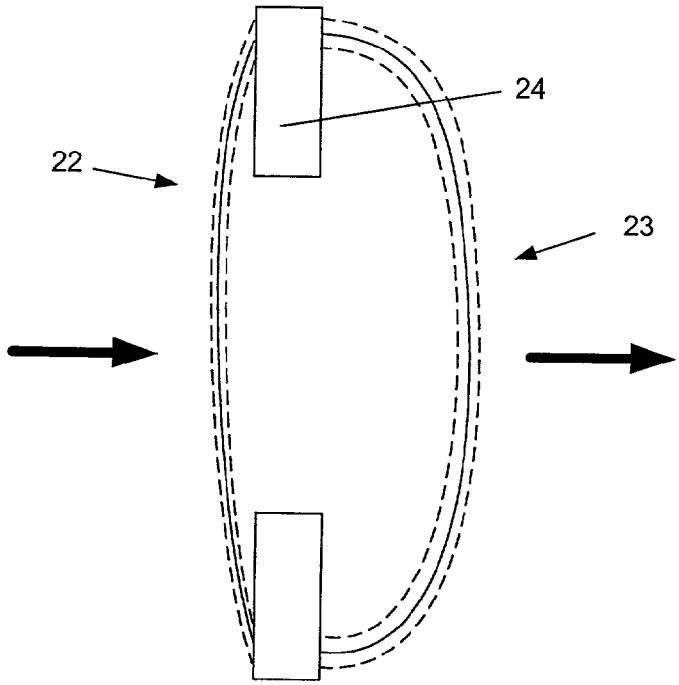
FIG. 6 is a schematic cross-sectional view of the dual diaphragm speaker with a first input polarity.
Figure 7:
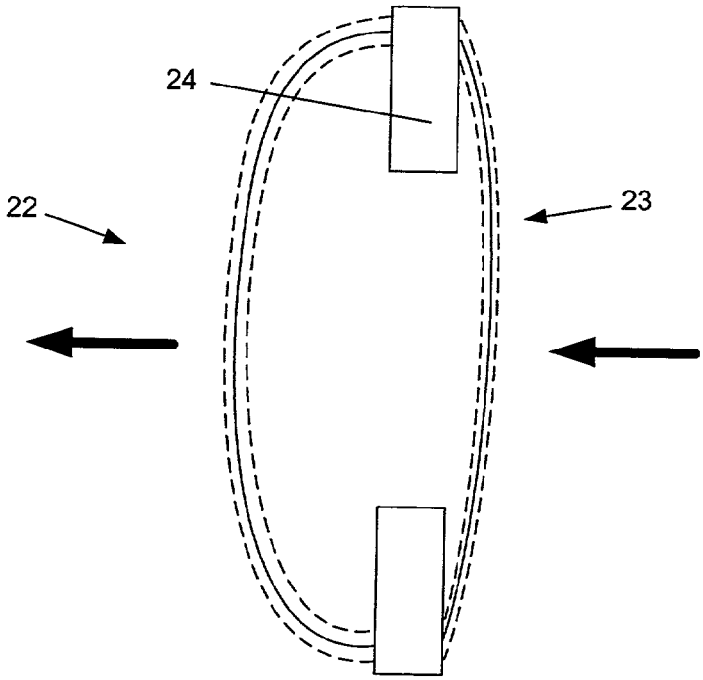
FIG. 7 is a schematic cross-sectional view of the dual diaphragm speaker with a second input polarity.

The operation of the dual diaphragm speaker will now be described with reference to FIGS. 5, 6 and 7. When a driving voltage of a first, for example, a positive polarity is applied to the input terminals 29, 30 from the amplifier 16, the first diaphragm 22 contracts as a result of the piezo-electric effect. At the same time, as a result of the electrode connections described above, the polarity of the electrodes 29, 30 of the second diaphragm 23 are reversed with respect to those of the first diaphragm 22. The second diaphragm 23 therefore expands as a result of the piezoelectric effect. The result is that both diaphragms move in the same direction, as shown in FIG. 6. Similarly, when the opposite polarity is applied to the input terminals 29, 30, the first diaphragm 22 elongates and the second diaphragm 23 contracts, so that both diaphragms again move in the same direction, being the opposite direction to that shown in FIG. 6, as illustrated in FIG. 7.

Therefore, as described in detail above, when the diaphragms 22, 23 are driven in opposite phase, both move in the same direction like a single diaphragm. As a result of the push-pull configuration, non-linearities due to the amount of expansion being greater or less than the amount of shrinkage for a given voltage, are effectively cancelled. Furthermore, the volume of gas between the diaphragms 22, 23 stays substantially constant during the excursions of the diaphragms, so that the tension of the diaphragms remains substantially constant. This removes another potential source of non-linearity with respect to a single diaphragm speaker. Since the volume of gas remains approximately the same during diaphragm excursions, the gas provides no stiffness, so that the speaker has a lower resonant frequency than a corresponding single diaphragm speaker and can be used over a wider frequency range.

While the invention has been primarily described with reference to a dual diaphragm speaker, other types of speaker can be mounted in front of the display 5 of a portable electronic device such as a mobile telephone or portable digital assistant, as long as they enable the display to be viewed through the speaker.

It will be appreciated by the skilled person that the speaker need not be limited to the rectangular shape and dimensions illustrated, but can be in the form of a convex lens or any other size or shape which is required to fit a particular device.

While the invention has primarily been described for use in a mobile telephone, it is also suitable for other types of portable electronic devices as well as for nonportable devices such as domestic speakers.

The invention claimed is:

1. an electronic device comprising a display, a speaker including first and second diaphragms enclosing a cavity and being arranged to be driven in opposite phase with respect to one another to cause the diaphragms to move in a same direction so that a volume of the cavity remains substantially constant and wherein the speaker is transparent and is mounted over the display so that the display is visible through the speaker.

2. An electronic device according to claim 1, wherein each of the first and second diaphragms comprises an element which exhibits a piezo-electric effect.

3. An electronic device according to claim 2, wherein the element comprises a piezoelectric film having a conductive coating on each side.

4. An electronic device according to claim 3, wherein the film comprises polyvinylidene fluoride (PVDF).

5. An electronic device according to claim 3, wherein the coating is indium tin oxide (ITO).

6. An electronic device according to claim 2, wherein the cavity is filled with a gas to keep the first and second diaphragms in tension.

7. An electronic device according to claim 6, wherein the gas is sulphur tetrafluoride.

8. An electronic device according to claim 1, wherein the first and second diaphragms are mounted on either side of an insulating support.

9. An electronic device according to claim 1, wherein the cavity is filled with a gas to keep the first and second diaphragms in tension.

10. An electronic device according to claim 9, wherein the gas is sulphur tetrafluoride.

11. An electronic device according to claim 1 which is portable.

12. A portable electronic device according to claim 11 comprising a mobile telephone.

13. An electronic device according to claim 1, wherein the speaker comprises a piezoelectric film speaker.

* * * * *